US006031709A

United States Patent [19]

Ziemkowski

[11] Patent Number: 6,031,709

[45] Date of Patent: Feb. 29, 2000

[54] SWITCHING MULTIPLEXOR ARRANGEMENT OF RELAYS FOR BALANCING THERMAL OFFSET

[75] Inventor: Ted B. Ziemkowski, Loveland, Colo.

[73] Assignee: Hewlett-Packard Co, Palo Alto

[21] Appl. No.: 09/118,951

[22] Filed: Jul. 17, 1998

[51] Int. Cl.[7] ..... H01H 51/28

[52] U.S. Cl. ..... 361/191; 307/115

[58] Field of Search ..... 361/160, 191; 307/113, 115, 147

[56] References Cited

PUBLICATIONS

HP E8460A 256–Channel Multiplexer User's Manual and SCPI Programming guide, Edition 1, Copyright 1997b Hewlett–Packard Company.

HP E1460A 64–Channel Relay Multiplexer User's Manual, Edition 5, Copyright 1995 Hewlett–Packard Company.

*Primary Examiner*—Fritz Fleming

[57] ABSTRACT

A switching multiplexor arrangement of relays having configuration flexibility and operative for balancing thermal offset of the relays Accumulated thermal offset of the relays along the various propagation paths through the multiplexor is balanced, by maintaining equal numbers of configured relays, along the various propagation paths, so that there are substantially equal amounts of accumulated thermal offset for the various propagation paths.

13 Claims, 11 Drawing Sheets

SWITCHING MULTIPLEXOR ARRANGEMENT OF RELAYS FOR BALANCING THERMAL OFFSET

FIELD OF THE INVENTION

The invention is generally directed to an electrical relay switching multiplexor and more particularly to a switching multiplexor arrangement of relays for balancing thermal offset of the relays.

BACKGROUND OF THE INVENTION

Various arrangements of electrical relays are known in the prior art for switching electrical signals. In one example of the prior art, a multiplexor arrangement of interconnected reed type relays provides for flexibly configuring the relays along electrical propagation paths coupled with selected I/O ports, so as to advantageously route the electrical signals from a large number of input/output (I/O) ports of the multiplexor, while limiting a number of the relays required.

For example, data acquisition applications may require monitoring a respective resistance value of each member of a large number of sensors. The multiplexor arrangement of interconnected relays provides for flexibly configuring the relays along electrical propagation paths coupled with selected I/O ports, so as to advantageously route the electrical signals between a large number of sensor monitoring input ports of the multiplexor and one or more output ports coupled with a meter for measuring the respective resistance value of each sensor.

While prior art switching matrices provide some advantages, they also include some limitations. For some reed type relays, over an operating temperature range between −40 degrees Centigrade and +85 degrees Centigrade, there is an individual thermal offset voltage drop of ten to thirty microvolts through each reed type relay that varies up to %500 in relation to the operating temperature of the reed type relay. At any given operating temperature, there still may be wide variability in thermal offsets of various reed type relays. Furthermore, for each configuration of the relays along a respective electrical propagation path, a respective accumulated thermal offset corresponds to summation of the individual thermal offsets of the relays of each configuration. Accordingly, if there are differing numbers of configured relays along various propagation paths, then there may be differing accumulated thermal offsets for the various propagation paths. This is undesirable since identical resistances of sensors would be misreported and measured as different, depending on the differing accumulated thermal offsets for the propagation paths used in the measurements.

Such difficulties become worse as numbers of the I/O ports increase and a corresponding complexity of the switching multiplexor increases. For example, so called four wire measurements provide some advantages in additional measurement sensitivity, primarily by attenuating contact resistance errors, but four wire measurements require twice as many I/O ports as two wire measurements, and increase switching multiplexor complexity. Four wire measurements use two wires to drive current through a resistance to be measured, and two additional wires to sense a corresponding voltage drop though the resistance. Since four wire measurements are more sensitive than two wire measurements, they are also more susceptible to the errors introduced by differing accumulated thermal offsets.

While four wire measurements are important, configuration flexibility for providing single wire measurements is also important.

What is needed is method and apparatus using a switching multiplexor arrangement of relays having configuration flexibility and operative for balancing thermal offset of the relays.

SUMMARY OF THE INVENTION

The method and apparatus of the invention uses a switching multiplexor arrangement of relays having configuration flexibility and operative for balancing thermal offset of the relays.

At a normal operating temperature, each relay has an individual thermal offset voltage drop there through that varies in relation to the operating temperature of the relay. For each configuration of the relays along a respective electrical propagation path between selected I/O ports of the multiplexor and selected measurement terminals of the multiplexor, a respective accumulated thermal offset corresponds to summation of the individual thermal offsets of the relays of each configuration. However, in accordance with principles of the invention discussed in further detail subsequently herein, accumulated thermal offset of the relays along the various propagation paths is balanced, by maintaining equal numbers of configured relays, along the various propagation paths, so that there are substantially equal amounts of accumulated thermal offset for the various propagation paths. In accordance with the invention, the relays are armature type relays, each selected to have individual thermal offset substantially equal to one another.

These aspects of the invention are highly desirable. For example, identical resistances of sensors measured using the invention are reported correctly, since the accumulated thermal offsets for the propagation paths used in the measurements are balanced.

The invention is especially advantageous in making sensitive measurements, for example, in making four wire measurements. Even though four wire measurements require twice as many I/O ports of the switching multiplexor as two wire measurements, and increase switching multiplexor complexity, using the principles of the invention still provides for balancing accumulated thermal offset of the relays along the various propagation paths.

While four wire measurements are important, configuration flexibility for providing single wire measurements is also important. The invention advantageously provides for flexible configuration for single wire measurements as well as four wire measurements.

Other aspects and advantages of the present invention will become apparent from the following detailed description, taken in conjunction with the accompanying drawings, illustrating by way of example the principles of the invention.

DETAILED DESCRIPTION OF PREFERRED EMBODIMENT

Figure 1:
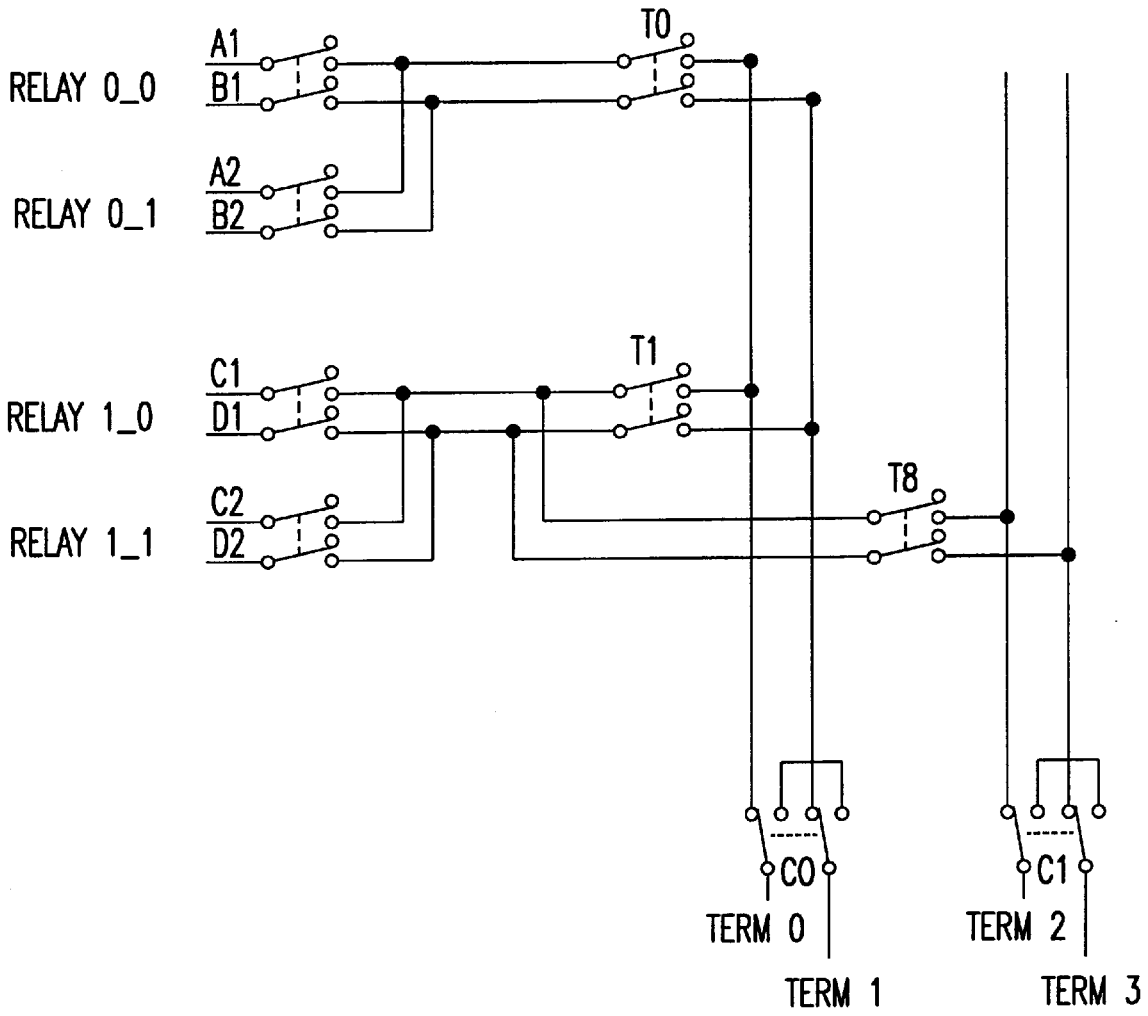
FIG. 1 shows a schematic diagram of a preferred embodiment of the invention.

FIG. 1 shows a schematic diagram of a preferred embodiment of the invention. As will be discussed in further detail subsequently herein, with reference to the figures, the invention uses a switching multiplexer arrangement of relays having configuration flexibility and operative for balancing thermal offset of the relays.

Figure 1A:
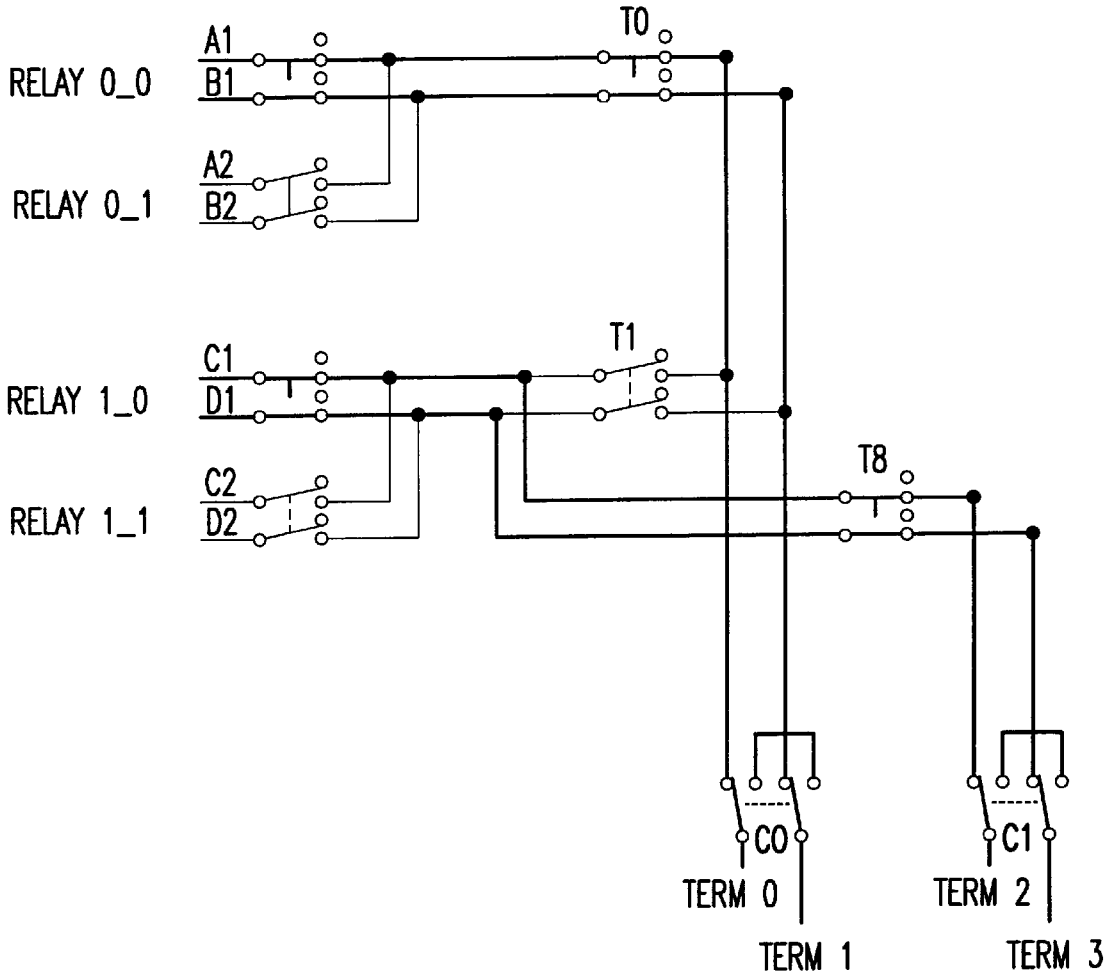
FIGS. 1A–1G are schematic diagrams illustrating various configuration states of the invention shown in FIG. 1.
Figure 1B:
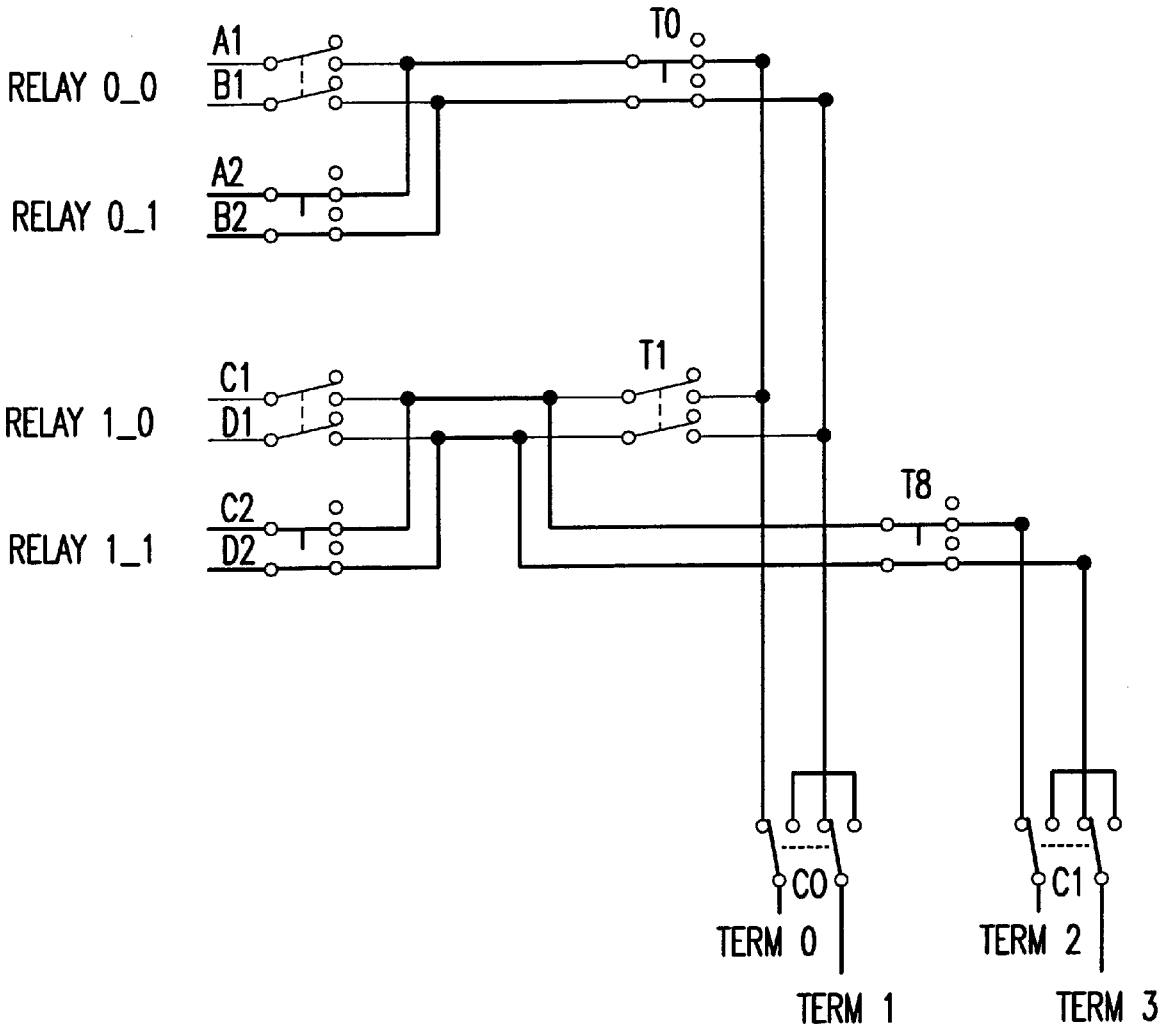
Figure 1C:
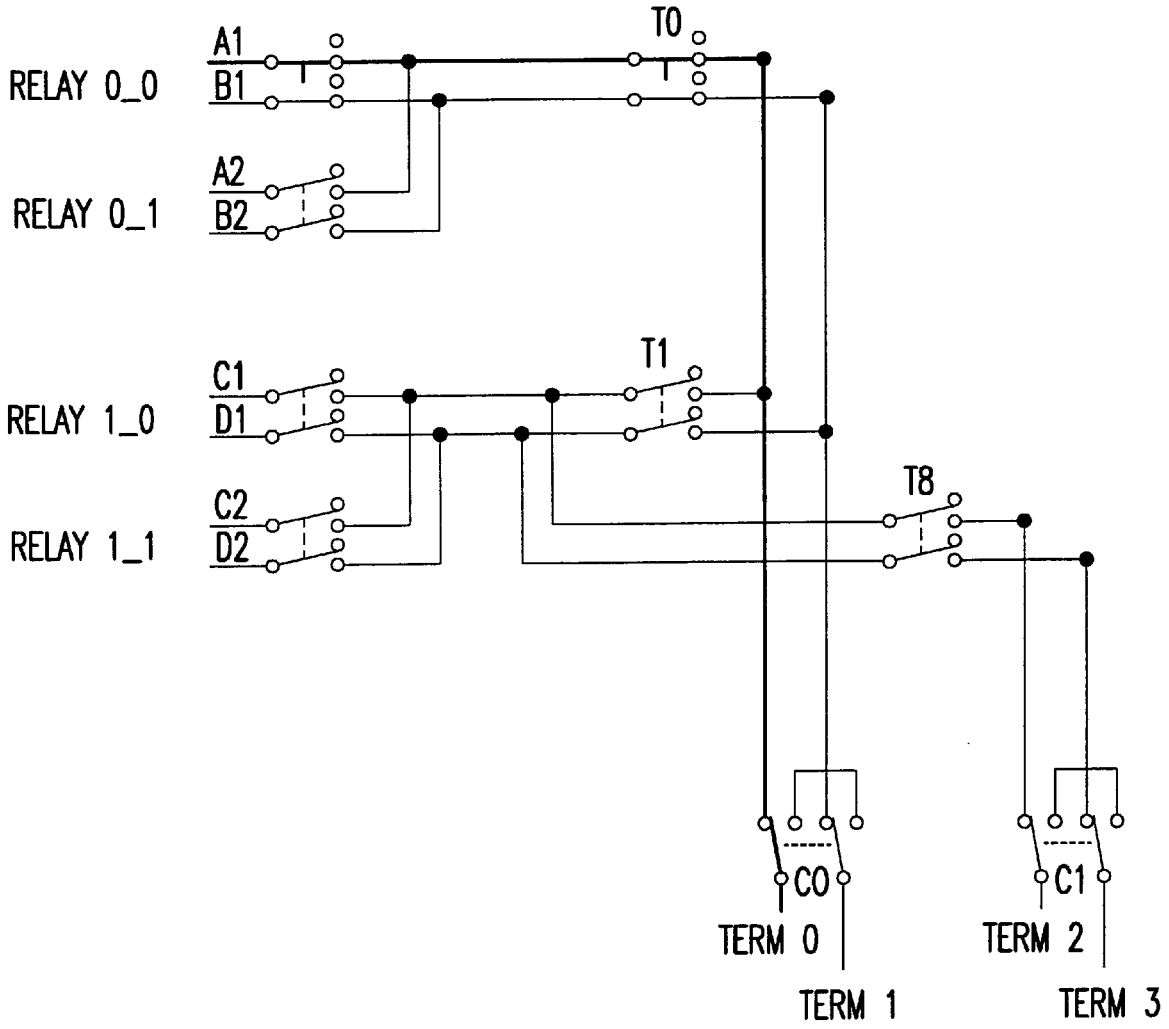
Figure 1D:
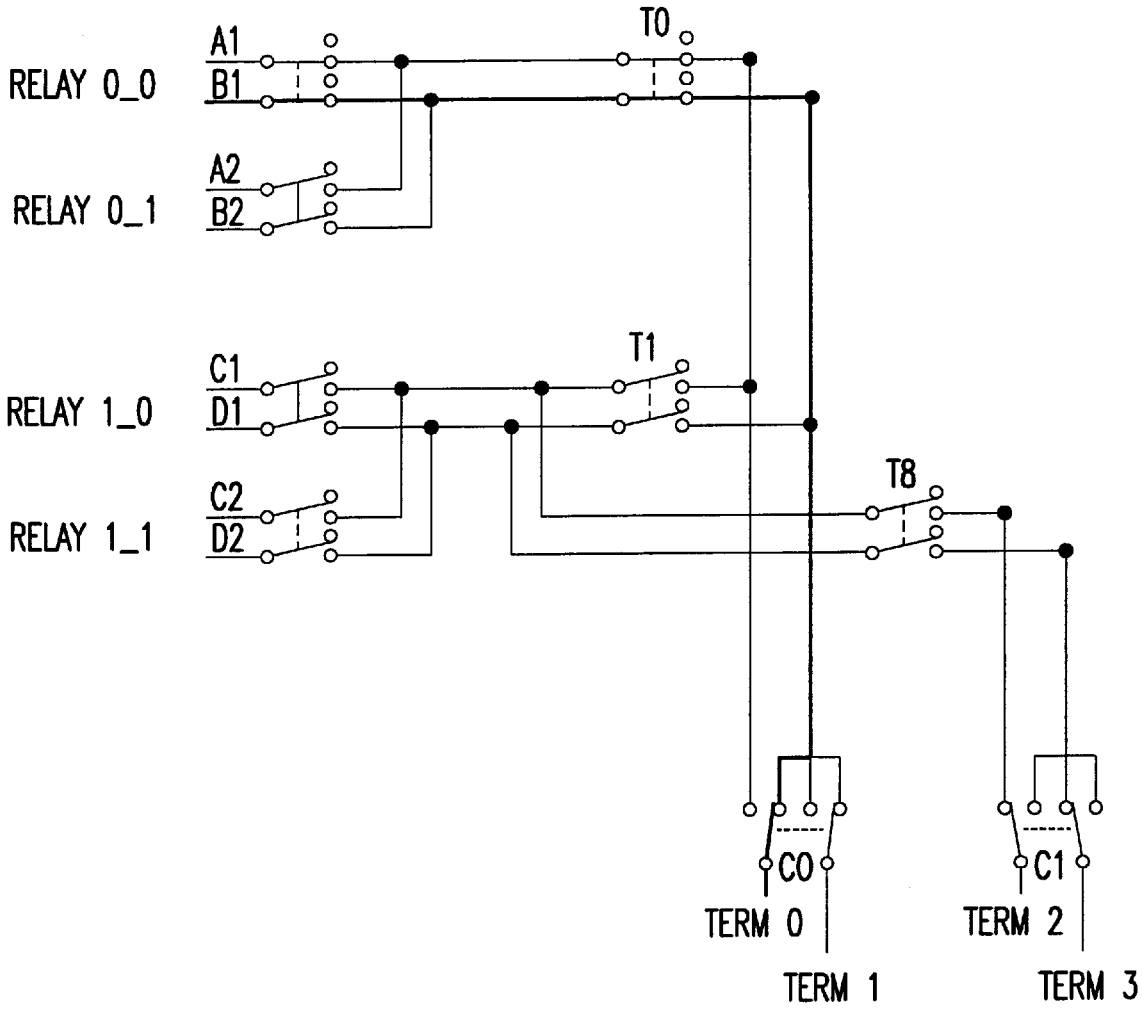

FIGS. 1A–1G are schematic diagrams illustrating various configuration states of the invention shown in FIG. 1. In particular, FIGS. 1A and 1B illustrate some configuration states of the invention for four wire measurements, while FIGS. 1C–1G illustrate some configuration states of the invention for single wire measurements.

As shown in FIG. 1A, form C relays (double pole-double throw armature type relays) are configured in a configuration state for a four wire measurement, routing four signals, from four selected I/O ports: A1, B1, C1 and D1 to four measurement terminals: Term0, Term1, Term 2 and Term 3. As shown in FIG. 1B, the form C relays (double pole-double throw armature type relays) are configured in another configuration state for another four wire measurement, routing another four signals, from four selected I/O ports: A2, B2, C2 and D2 to the four measurement terminals: Term0, Term1, Term 2 and Term 3. Accordingly the invention provides for multiplexing for four wire measurements.

In the FIGS. 1A–1G illustrating configuration states of the invention, lines are heavily drawn to show signal propagation paths. For example in FIG. 1A lines are heavily drawn to illustrate a propagation path from Al through a first from C relay, Relay, 0_0, on through a second form C relay, TO, and through a third form C relay, CO, to a first one of the measurement terminals, Term0. Similarly lines are heavily drawn to illustrate three additional propagation paths, each path passing through a respective total of three form C relays. Heavily drawn lines are also used to illustrate an alternative four propagation paths in FIG. 1B each path passing through a respective total of three form C relays.

In the preferred embodiment, for a normal operating temperature between −40 degrees Centigrade and +85 degrees Centigrade, each relay has an individual thermal offset voltage drop there through of approximately one half of a microvolt that varies in relation to the operating temperature of the relay. For each configuration of the relays along the respective electrical propagation path between selected I/O ports of the multiplexor and selected measurement terminals of the multiplexor, a respective accumulated thermal offset corresponds to summation of the individual thermal offsets of the relays of each configuration. However, as shown in FIGS. 1A and 1B, in accordance with principles of the invention, accumulated thermal offset of the relays along the various propagation paths is balanced, by maintaining equal numbers of configured relays (specifically, the total of three form C relays), along the various propagation paths, so that there are substantially equal amounts of accumulated thermal offset for the various propagation paths. Accordingly, for the four wire measurements, the accumulated thermal is approximately one and one half microvolt or better (computed as one half microvolt per relay, summed for the three relays configured in the propagation path). In accordance with the invention, the form C relays are armature type relays, each selected to have individual thermal offset substantially equal to one another.

While four wire measurements are important, configuration flexibility for providing single wire measurements is also important. Single wire measurements require sufficient configuration flexibility so that at least one measurement terminal can be coupled through a respective propagation path with each one of the four or more I/O ports of the multiplexor. The invention advantageously provides for flexible configuration for singe wire measurements as well as four wire measurements.

FIGS. 1C–1G illustrate some configuration states of the invention for single wire measurements. For example, in FIG. 1C lines are heavily drawn to illustrate a propagation path for a single wire measurement from A1 through a first from C relay, Relay, 0_0, on through a second form C relay, TO, and through a third form C relay, CO, to the first one of the measurement terminals, Term0. Similarly, in FIG. 1D lines are heavily drawn to illustrate a propagation path for a single wire measurement from B1 through the first from C relay, Relay, 0_0, on through the second form C relay, TO, and through the third form C relay, CO, to the first one of the measurement terminals, Term0.

Figure 1E:
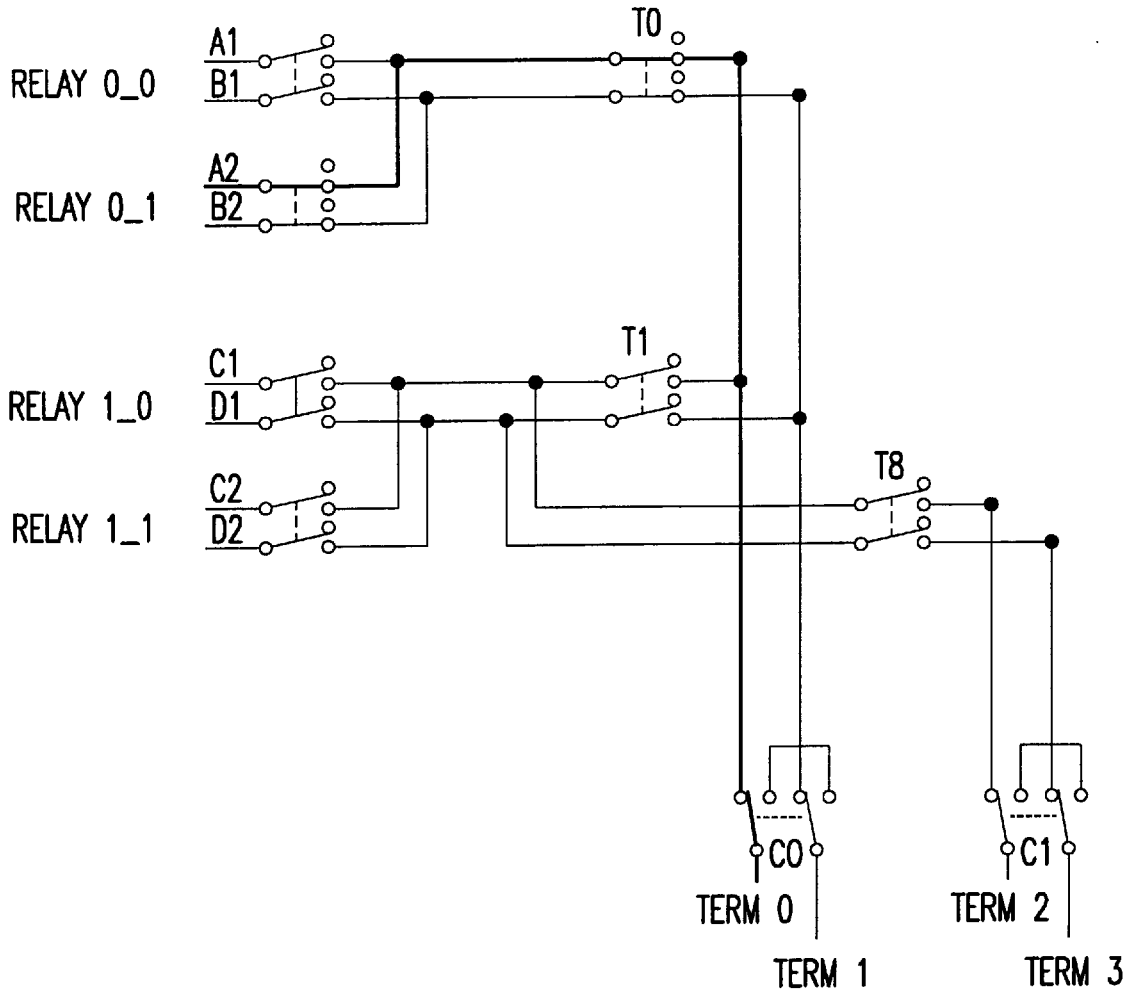
Figure 1F:
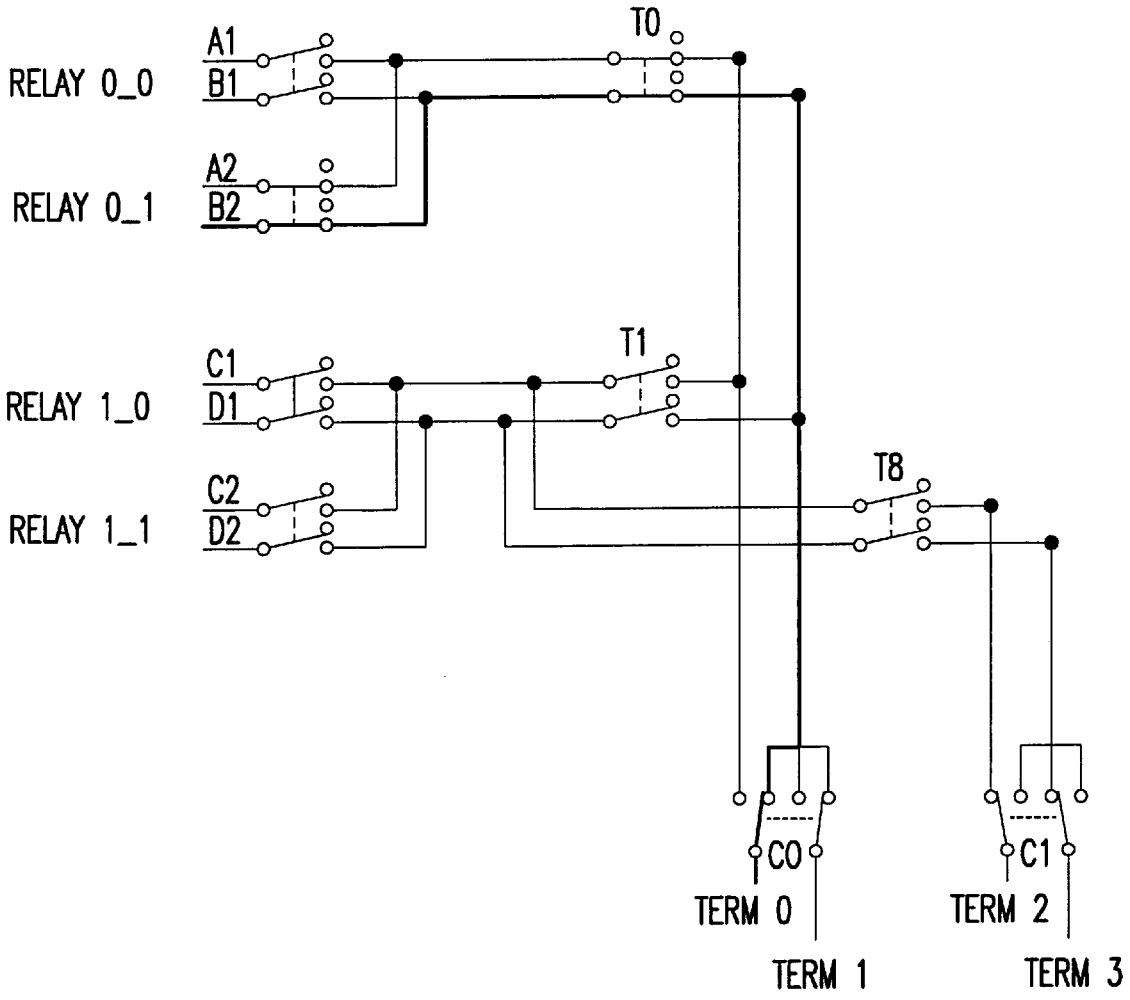
Figure 1G:
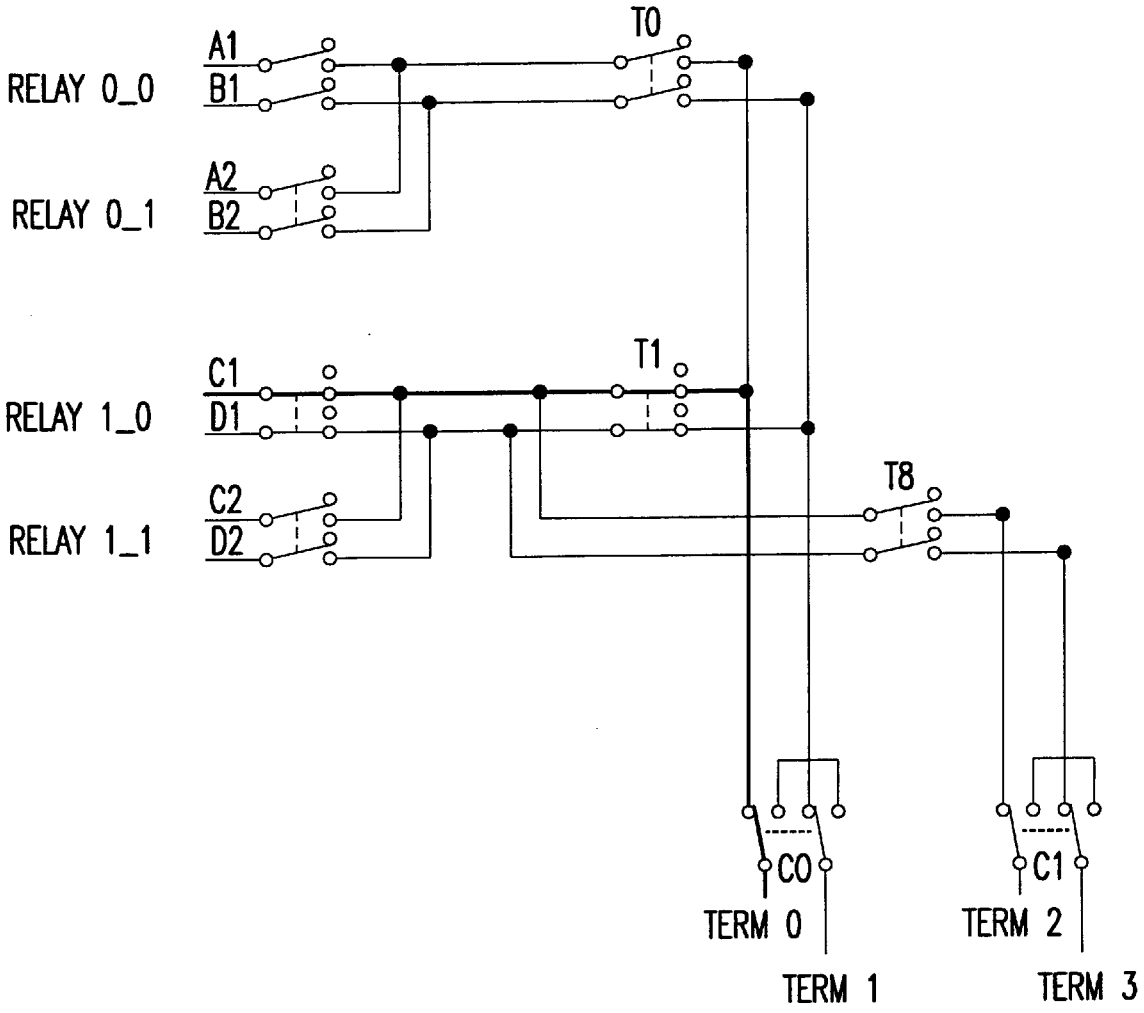

FIG. 1E illustrates another single wire measurement configuration state of the relays for providing a propagation path, highlighted using heavily drawn lines, from I/O port A2 though three relays, to the measurement terminal, Term0. FIG. 1F illustrates another single wire measurement configuration state of the relays for providing a propagation path, highlighted using heavily drawn lines, from I/O port B2 though three relays, to the measurement terminal, Term0. FIG. 1G illustrates another single wire measurement configuration state of the relays for providing a propagation path, highlighted using heavily drawn lines, from I/O port C1 though three relays, to the measurement terminal, Term0. In similar ways, the mulitplexor of the invention is configurable for single wire measurements to provide a respective propagation path between the measurement terminal, Term0 and each of the three remaining I/O ports: D1, C2 and D2. The configuration flexibility of the invention further provides for two wire measurements as well as three wire measurements.

Figure 2:
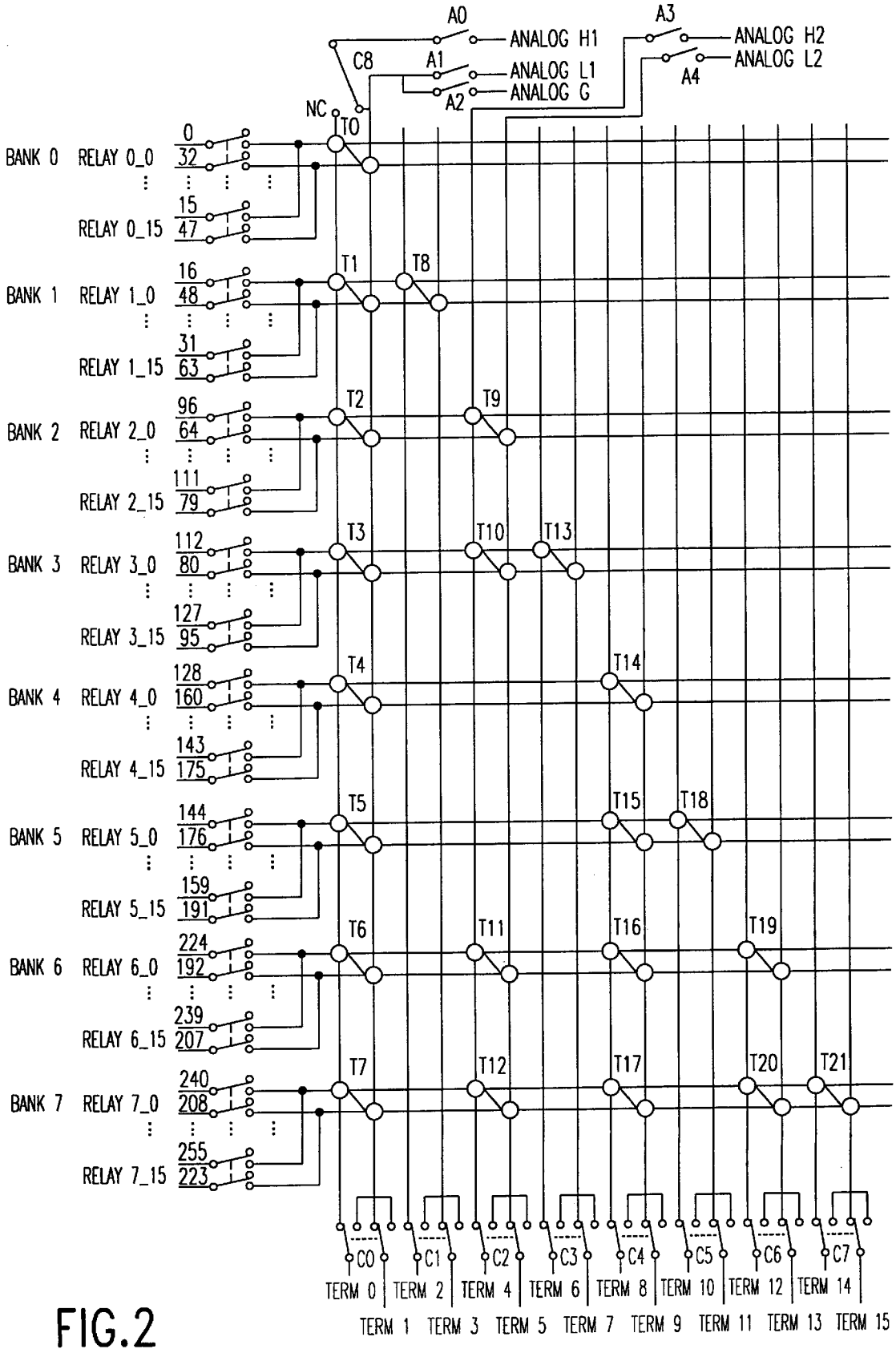
FIG. 2 shows a simplified schematic diagram of a another preferred embodiment of the invention.

FIG. 2 shows a simplified schematic diagram of a another preferred embodiment of the invention; which provides for various configurations of the form C relays including configuration states for a one to two hundred and fifty six channel multiplexor. As shown, the two hundred and fifty six I/O ports are organized into eight banks. For the sake of simplicity, in FIG. 2 only the first two and last two channels of each bank are explicitly shown. Form C relays T0,T1, and T8 operate as discussed previously herein with respect to FIGS. 1A–1G, however a simplified schematic representation is used in FIG. 2 for form C relays T0 through T21. The embodiment of FIG. 2 advantageously provides sixteen measurement terminals (Term0 through Term15).

Figure 3:
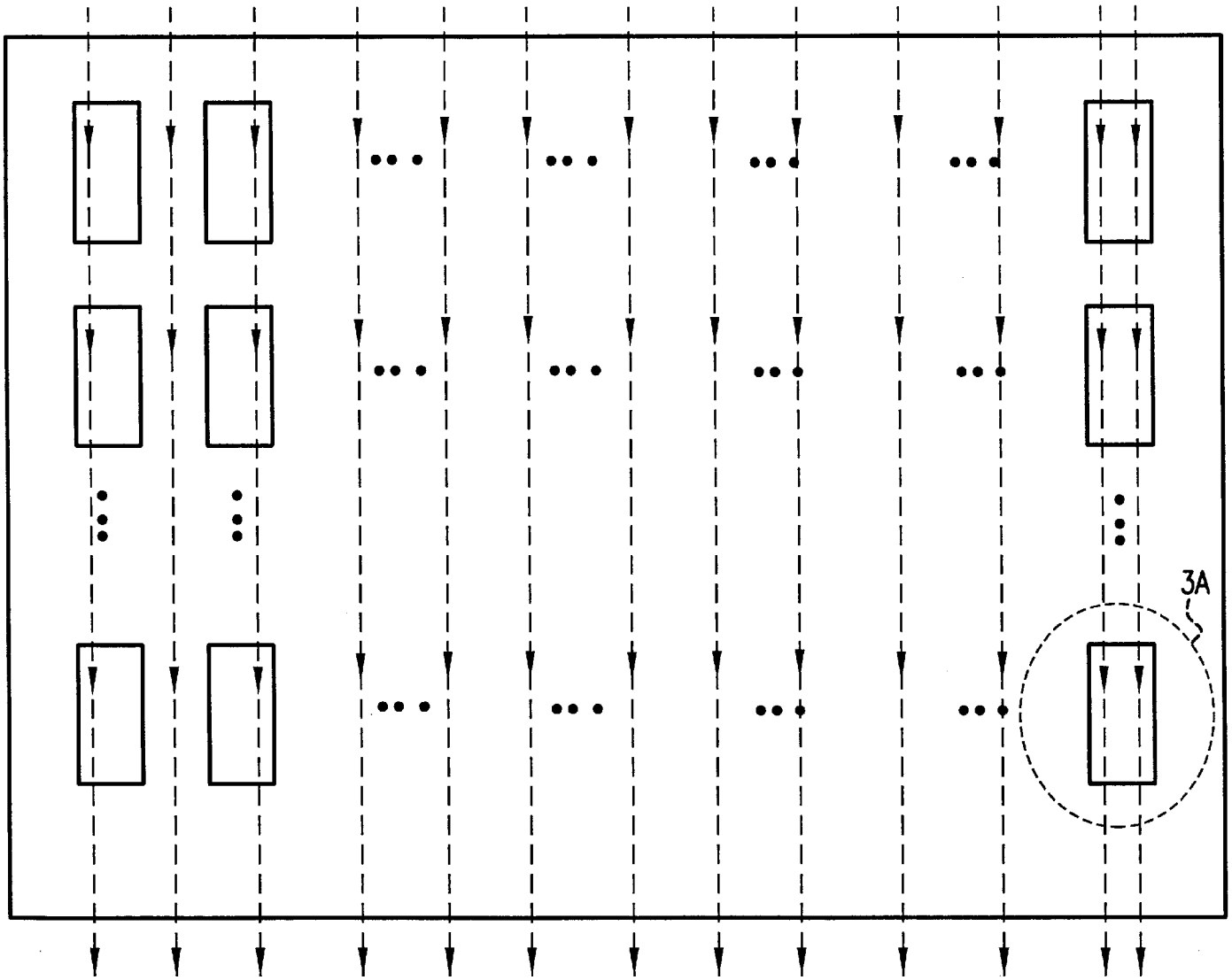
FIG. 3 is a simplified block diagram illustrating another aspect of the preferred embodiments of the invention.

FIG. 3 is simplified a block diagram illustrating another aspect of the preferred embodiments of the invention. A large rectangular block in FIG. 3 represents a printed wiring board assembly for supporting and interconnecting the form C relays of the invention, which are represented by smaller rectangles. Within protective packaging each of the relays includes a respective armature having a respective longitudinal dimension.

In the preferred embodiments, each of the relays includes a respective armature having a respective longitudinal dimension. The arrangement of the relays includes an orientation of substantially all of the relays so that the longitudinal dimensions of the armatures are substantially parallel to one another. A cooling air flow is directed proximately along the longitudinal dimensions of the armatures of the relays. Of course, air flow is invisible. Accordingly, the air flow is representatively illustrated in FIGS. 3 and 3A using directed dashed line arrows. Advantageous uniform cooling and balancing of thermal offset among the relays are provided, since substantially all of the relays are oriented so that the longitudinal dimensions of the armatures are substantially parallel to one another.

Figure 3A:
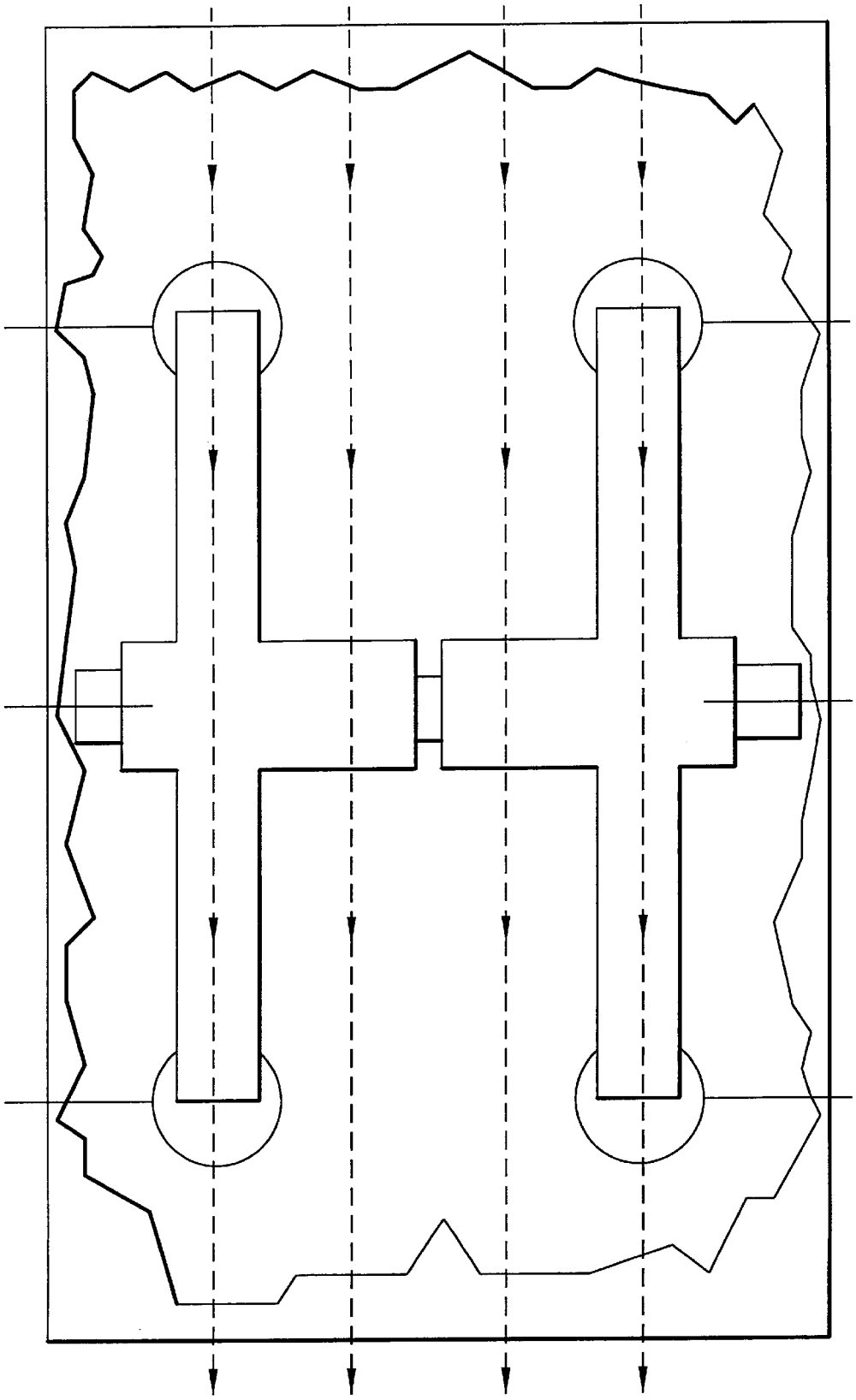
FIG. 3A is a simplified cut away view of a typical one of the relays shown in FIG. 3.

FIG. 3A is a simplified cut away view of a typical one of the relays shown in FIG. 3. As shown, with the protective packaging cut away, each of the form C relays of the invention is double pole-double throw, including a respective pair of armatures having a longitudinal dimensions. Directed proximately along the longitudinal dimensions of the of the armatures is the cooling air flow, representatively illustrated using directed dashed line arrows.

As shown in FIG. 3A, perpendicular to the longitudinal dimensions of the armatures is a central rocker axis for supporting the armatures in a rocking motion. During configuration of the double pole-double throw relay, extremities of the armatures move together to engage either a first pair of circular electrical contact pads, or a second pair of circular electrical contact pads. A respective electrical lead extends outwardly from each of the circular electrical contact pads, and outwardly though the protective packaging of the relay, for electrical interconnection with other relays. Similarly, a respective electrical lead extends outwardly from central connection with each of the armatures, and outwardly though the protective packaging of the relay.

Accordingly, it should be understood that configuration of the relay provides for propagation paths at least part way along the longitudinal dimensions of the armatures. The cooling air flow is directed substantially parallel to the propagation paths though the relay, along longitudinal dimensions of the armatures of the relay. It is theorized that this contributes to the advantageous uniform cooling and balancing of thermal offset among the relays.

As discussed, the method and apparatus of the invention provides a switching multiplexor arrangement of relays having configuration flexibility and operative for balancing thermal offset of the relays. Although specific embodiments of the invention have been described and illustrated, the invention is not to be limited to the specific forms or arrangements parts so described and illustrated, and various modifications and changes can be made without departing from the scope and spirit of the invention. Within the scope of the appended claims, therefor, the invention may be practiced otherwise than as specifically described and illustrated.

What is claimed is:

1. An apparatus comprising:

a plurality of configurable relays, each relay having an individual thermal offset voltage drop there through;

an arrangement of the relays interconnected in a switching multiplexor having a plurality of I/O ports and measurement terminals and having a plurality of configuration states, wherein each configuration state of the multiplexor includes configuration of the relays along a respective electrical propagation path between selected I/O ports of the multiplexor and measurement terminals of the multiplexor; and a respective accumulated thermal offset corresponding to summation of the individual thermal offsets of the respective relays along each propagation path, wherein the relays are interconnected in such a way that the accumulated thermal offset for each of the propagation paths are substantially equal to one another.

2. An apparatus as in claim 1 wherein the relays are armature type relays, each selected so that their individual thermal offsets are substantially equal to one another.

3. An apparatus as in claim 1 wherein there are equal numbers of configured relays along each of the propagation paths.

4. An apparatus as in claim 1 wherein the relays are form C type relays, each selected so that their individual thermal offsets are substantially equal to one another.

5. An apparatus as in claim 1 wherein the relays are form C type relays.

6. An apparatus as in claim 1 wherein:

each of the relays includes a respective armature having a respective longitudinal dimension; and the arrangement of the relays includes an orientation of substantially all of the relays so that the longitudinal dimensions of the armatures are substantially parallel to one another.

7. An apparatus as in claim 6 further comprising a cooling air flow directed proximately along the longitudinal dimensions of the armatures of the relays.

8. An apparatus as in claim 6 further comprising a cooling air flow directed substantially parallel to the propagation paths though the armatures of the relays, along the longitudinal dimensions of the armatures of the relays.

9. An apparatus as in claim 1 wherein the arrangement of the relays is interconnected in the switching multiplexor, so that the configuration states of the relays of the multiplexor include configurations operative for single wire measurements and configurations operative for four wire measurements.

10. A method comprising the steps of:

providing a plurality of configurable relays, each relay having an individual thermal offset voltage drop there through;

arranging the relays interconnectedly in a switching multiplexor having a plurality of I/O ports and measurement terminals and having a plurality of configuration states, wherein each configuration state of the multiplexor includes configuration of the relays along a respective electrical propagation path between selected I/O ports of the multiplexor and measurement terminals of the multiplexor; and maintaining a respective accumulated thermal offset, corresponding to summation of the individual thermal offsets of the respective relays along each propagation path, so that there are substantially equal amounts of accumulated thermal offset for each of the propagation paths.

11. A method as in claim 10 further comprising a step of maintaining equal numbers of configured relays along each of the propagation paths.

12. A method as in claim 10 further comprising a step of orienting substantially all of the relays so that longitudinal dimensions of the armatures of the relays are substantially parallel to one another.

13. A method as in claim 12 further comprising a step of directing a cooling air flow proximately along the longitudinal dimensions of the armatures of the relays.

* * * * *